US007618519B2

(12) United States Patent
Bonnafous et al.

(10) Patent No.: US 7,618,519 B2
(45) Date of Patent: Nov. 17, 2009

(54) CATHODE ELEMENT FOR USE IN AN ELECTROLYTIC CELL INTENDED FOR PRODUCTION OF ALUMINUM

(75) Inventors: Delphine Bonnafous, Aiton (FR); Jean-Luc Basquin, St. Jean de Maurienne (FR); Claude Vanvoren, La Murette (FR)

(73) Assignee: Aluminum Pechiney, Paris (FR)

( * ) Notice: Subject to any disclaimer, the term of this patent is extended or adjusted under 35 U.S.C. 154(b) by 730 days.

(21) Appl. No.: 11/095,487

(22) Filed: Apr. 1, 2005

(65) Prior Publication Data

US 2005/0218006 A1 Oct. 6, 2005

(30) Foreign Application Priority Data

Apr. 2, 2004 (FR) ..... 04 03497

(51) Int. Cl.
*C25C 3/08* (2006.01)

(52) U.S. Cl. ..... 204/247.1; 204/243.1; 204/247.4; 204/247.5; 204/279; 204/280

(58) Field of Classification Search ..... 204/243.1, 204/247.4, 247.5, 279, 280, 247.1
See application file for complete search history.

(56) References Cited

U.S. PATENT DOCUMENTS

| | | | | |
|---|---|---|---|---|
| 2,593,751 | A | 4/1952 | Grolee | |
| 2,846,388 | A | 8/1958 | Morel | |
| 3,551,319 | A | 12/1970 | Elliott | |
| 4,110,179 | A | 8/1978 | Tschopp | |
| 5,976,333 | A * | 11/1999 | Pate | 204/279 |
| 6,294,067 | B1 * | 9/2001 | Gauthier et al. | 205/372 |
| 2004/0050714 | A1 | 3/2004 | Torvund | |
| 2008/0135417 | A1 * | 6/2008 | Allano et al. | 205/560 |

FOREIGN PATENT DOCUMENTS

| | | |
|---|---|---|
| EP | 0938598 | 6/1997 |
| FR | 1161632 | 12/1956 |
| RU | 2179201 | 2/2002 |
| RU | 2239007 | 10/2004 |
| WO | WO 01/27353 | 4/2001 |
| WO | WO 01/63014 | 8/2001 |
| WO | WO 02/42525 | 5/2002 |
| WO | WO 2004/031452 | 4/2004 |

OTHER PUBLICATIONS

Russian Office Action for Application No. 2006138619/02, dated Mar. 16, 2009.

* cited by examiner

*Primary Examiner*—Bruce F Bell
(74) *Attorney, Agent, or Firm*—Banner & Witcoff Ltd.

(57) ABSTRACT

This invention relates to a cathode element for use in a pot of an electrolytic cell intended for production of aluminum. The cathode element comprises a cathode block and a steel connection bar. The connection bar includes at least one metal insert, whose electrical conductivity is greater than the electrical conductivity of the said steel. The presence of an insert according to the invention can simultaneously result in a very large drop in the global cathode voltage and a very strong reduction in the current density at the head of the block.

27 Claims, 4 Drawing Sheets

CATHODE ELEMENT FOR USE IN AN ELECTROLYTIC CELL INTENDED FOR PRODUCTION OF ALUMINUM

CROSS REFERENCE TO RELATED APPLICATIONS

This application claims priority under 35 USC 119 from FR 0403497 filed Apr. 2, 2004, the content of which is incorporated herein by reference in its entirety.

BACKGROUND OF THE INVENTION

1. Field of the Invention

The present invention relates generally to the production of aluminum by fused bath electrolysis. In particular, it relates to cathode elements suitable for use in electrolytic cells intended for production of aluminum.

2. Description of Related Art

The cost of energy is an important concern when analyzing the operating costs of aluminum reduction plants. Consequently, a reduction in the specific energy consumption of electrolytic cells is very important for these plants. The specific consumption of a cell is equal to the energy consumed by the cell to produce one metric ton (tonne) of aluminum. It is expressed in kWh/t and, for a constant current efficiency, is directly proportional to the electrical voltage at the terminals of the electrolytic cell.

The electrical voltage of an electrolytic cell can be subdivided into several voltage drops, namely (i) the anode voltage drop, (ii) the voltage drop in the bath, (iii) the electrochemical voltage, (iv) the cathode voltage drop and line losses. The cathode voltage drop depends on the electrical resistance of the cathode element that includes a cathode block made of a carbonaceous material and one or several metal connecting bars.

The materials from which the cathode blocks are made have changed over time such that the electrical resistance to current passing through the blocks has been getting lower and lower. As such, there are increased currents passing through the cells, while a constant cathode voltage drop is maintained.

In the 1970s, cathode blocks were made of anthracite (amorphous carbon). This material offered a fairly high electrical resistance. Faced with the needs of plants to increase their current intensity in order to increase their production, these blocks were progressively replaced with so-called "semi-graphite" blocks (containing between 30% and 50% of graphite) starting from the 1980s, then by so-called "graphite" blocks containing 100% graphite grains but whose binder between these grains remained amorphous. Since the graphite grains of these blocks have a low electrical resistance, the blocks present a lower electrical resistance to current passing through them and consequently, for constant intensity, the cathode voltage drop is reduced.

Finally, the most recent block types are so-called "graphitized" blocks. A high temperature graphitization heat treatment is carried out on these blocks, increasing the electrical conductivity of the block by graphitization of the carbon.

At the same time as these above improvements were being implemented to reduce the electrical resistance of materials, the current used in aluminum reduction plants was increased. This increase in current consequently increased the plant's production (for constant current efficiency, the number of tonnes of metal produced by a cell is proportional to the intensity of the current that passes through it). Since the cathode voltage drop Uc is equal to the product of the cathode resistance Rc and the intensity I of the current circulating in the cathode ($Uc=Rc\times I$), the cathode voltage drops remained high, typically about 300 mV.

Furthermore, changes to the properties of cathode blocks have led to the emergence of new problems such as, for example, erosion of cathodes. For example, it has been observed that as the quantity of graphite contained in cathode blocks increases, a block becomes more sensitive to erosion problems at the head of the block. The current density is not distributed uniformly over the entire width of the pot, and there is a peak current density at each end of the block, on the surface of the cathode. This peak current density causes local erosion of the cathode, which is particularly marked when the block is rich in graphite. These very high erosion areas can limit the life of the pot, which is a major economic problem for an aluminum reduction plant.

It is known that the cathode voltage drop Uc can be reduced by using composite connection bars including a steel part and a part made of a metal with an electrical conductivity higher than steel, usually copper. Examples of patents include French patent application FR 1 161 632 (Pechiney), U.S. Pat. No. 2,846,388 (Pechiney), U.S. Pat. No. 3,551,319 (Kaiser) and international application WO 02/42525 (Servico).

It is also known from international applications WO 01/63014 (Comalco) and WO 01/27353 (Alcoa), that copper inserts can be used to improve the distribution of current along the cathode block. These documents teach to enclose a copper insert in the steel connection bar and to confine the insert inside the cell in order to reduce conduction of heat out of the cell.

However, these solutions are, first of all, expensive because copper is more expensive than steel and the copper quantities involved may be high. In the most frequently used technologies, the number of bars per electrolytic pot is usually between 50 and 100. Therefore the extra cost associated with the presence of copper components increases very quickly.

Furthermore, even the known revised configurations are not fully satisfactory. These configurations cause reductions in the global cathode voltage drop (in other words including the voltage drop in the bar) on the order of 50 mV, which is too low to justify the additional investment costs, and produce relatively high peak current densities at the head of the block, namely more than about 12 $kA/m^2$.

Therefore the applicants tried to find satisfactory solutions to the drawbacks of prior art, and particularly to the problem of specific consumption.

SUMMARY OF THE INVENTION

The present invention therefore relates to a system that provides reduction in the cathode voltage drop to reduce the specific consumption of electrolytic cells.

In accordance with this and other objects, the present invention provides a cathode element suitable for use in a pot of an electrolytic cell capable of use in the production of aluminum, the cathode element comprising:

- a cathode block comprising a carbonaceous material having at least one longitudinal groove along a side face thereof;
- at least one steel connection bar, wherein at least one part of the bar called the "external segment" is capable of being located outside a pot, a portion of the bar is housed in the groove, and another portion of the bar called the "part outside the block" emerges at least at one end of the block called the "block head", and which is sealed in the groove by a conducting sealing material such as cast iron or a conducting paste inserted between the bar and the block.

In a cathode element according to the instant invention, the connection bar preferably includes, for each external segment, at least one metal insert with a length Lc, whose electrical conductivity is greater than the electrical conductivity of steel, the metal insert is arranged longitudinally inside the bar and is at least partly located in the external segment; for each external segment the connection bar is advantageously not sealed to the cathode block in at least one zone called the "unsealed" zone having a surface area S and which is located at the end of the groove at the head of the block.

Preferably, the insert is flush (with a defined tolerance) with the surface of the end of the external segment.

Advantageously, the insert or each insert comprises copper or a copper based alloy.

The use of an insert according to the present invention can simultaneously result in (i) a very large drop in the global cathode voltage (for example 0.2 V for a bar with a copper insert compared with 0.3 V for an entirely steel bar) and (ii) a very strong reduction in the current density at the head of the block (generally at least on the order of 20%).

The invention also relates to an electrolytic cell comprising at least one cathode element according to the present invention.

Additional objects, features and advantages of the invention will be set forth in the description which follows, and in part, will be obvious from the description, or may be learned by practice of the invention. The objects, features and advantages of the invention may be realized and obtained by means of the instrumentalities and combination particularly pointed out in the appended claims.

BRIEF DESCRIPTION OF THE DRAWINGS

The invention is described in detail below with reference to the appended figures.

DETAILED DESCRIPTION OF A PREFERRED EMBODIMENT

It was discovered by the present applicants that a large part of the drop in the cathode voltage (about one third) is located in the part of the bar "outside the block" (i.e. that part that extends out of the block). In fact, the current density in the bar increases towards the part of the bar located outside the block and reaches a maximum value at the point the bar exits the block. Consequently, over the entire part of the bar located "outside the block", a small section carries a large quantity of current, which causes a large voltage drop.

The applicants had the idea of combining an unsealed zone close to the head of the cathode block, and at least one insert in each external segment of the connection bar that extends preferably over substantially the entire length of the segment. They observed that, unexpectedly, the combined effect of these characteristics very significantly reduces the peak current density that exists at the head of the block, (in other words close to the ends of the block), while very significantly reducing the cathode voltage drop. In particular, it was discovered that the unsealed zone can significantly reduce the impact of the ridge base on the peak current density.

The present invention is particularly attractive when the carbonaceous material comprises graphite.

A suitable process for manufacturing a connection bar that could be used in a cathode element according to the present invention, advantageously includes the formation of a longitudinal cavity—typically a blind hole—in a steel bar starting from one end of the steel bar. It further includes manufacturing an insert comprising a material with a conductivity that is higher than the steel from which the bar is made, and having a length and a section corresponding to the length and section of the cavity, and then introducing the insert into the cavity.

Intimate contact between the insert and the bar is usually achieved as the pot temperature increases, due to the presence of a differential thermal expansion between the insert and the bar (since steel expands relatively little compared with other metals).

Figure 1:
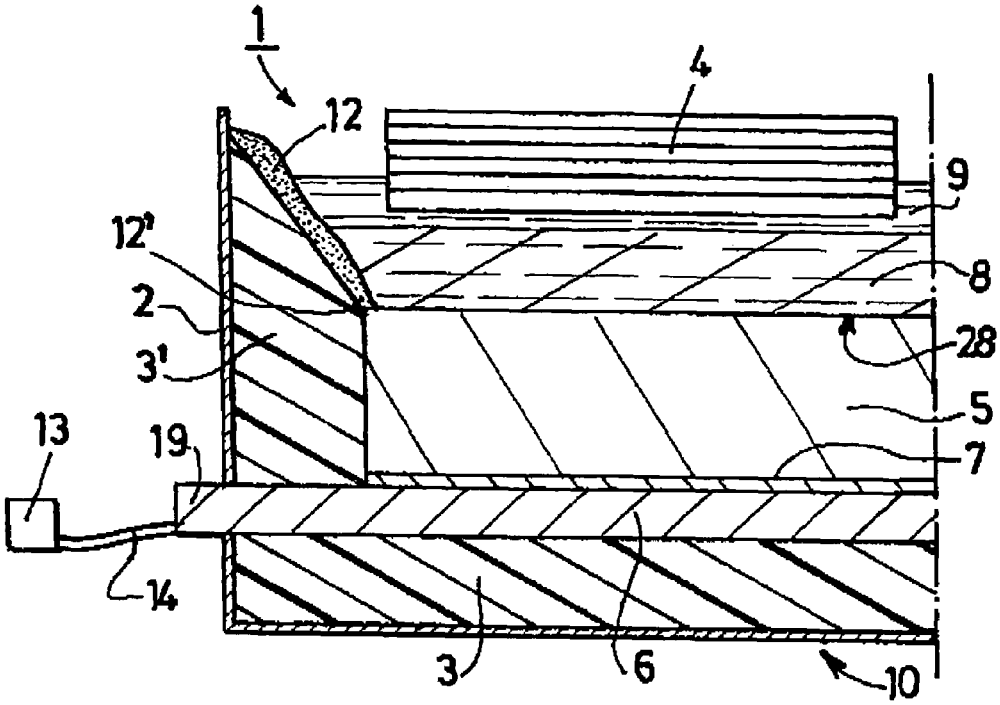
FIG. 1 shows a cross-sectional view of a traditional half-pot.

As illustrated in FIG. 1, a suitable electrolysis cell 1 comprises a pot 10 and at least one anode 4. The pot 10 comprises a pot shell 2 whose bottom and sidewalls are covered with elements made of a refractory material 3 and 3'. Cathode blocks 5 are supported on the bottom refractory elements 3. Connection bars 6, usually made of steel, are sealed into the lower part of the cathode blocks 5. The seal between the connection bar(s) and the cathode block 5 is usually made by using cast iron or conducting paste 7 or similar or like material.

Figure 3:
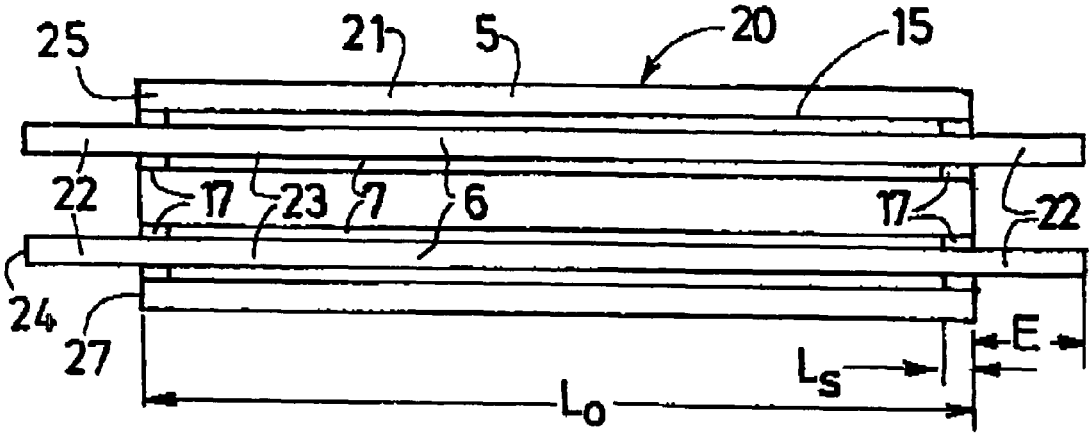
FIG. 3 shows a bottom view of a cathode element according to one embodiment of the invention.
Figure 4:
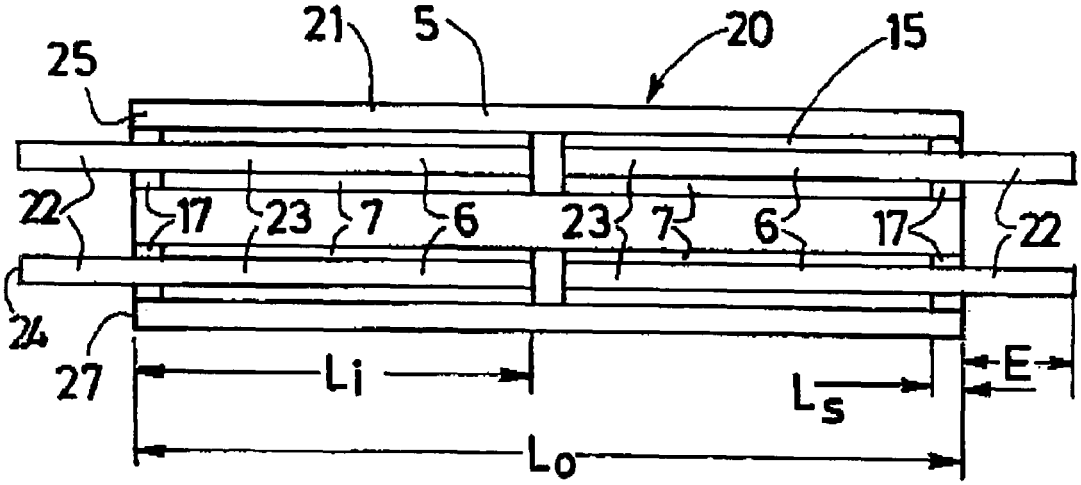
FIG. 4 shows a bottom view of a cathode element according to another embodiment of the invention.
Figure 5:
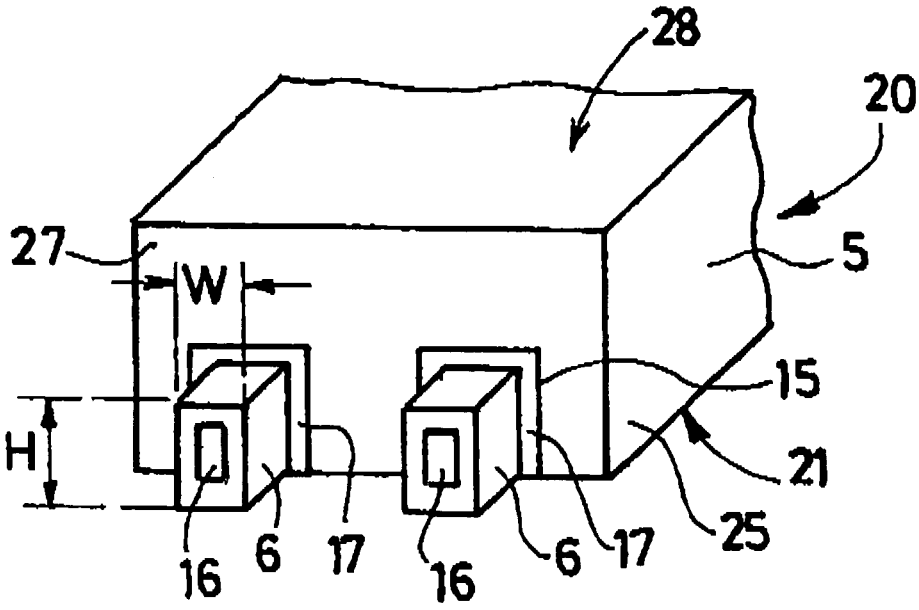
FIG. 5 shows a perspective view of one end of the cathode block in FIG. 3 or 4.

As illustrated in FIGS. 3 to 5, the cathode blocks 5 are preferably substantially parallelepiped in shape with length Lo, in which one of the side faces 21 has one or several longitudinal grooves 15 in which the connection bars 6 will be housed. The grooves 15 open up at the head of the block and generally extend from one end of the block to the other. The length of the so-called "part outside the block" 22 of the bar 6 that emerges from the cathode block 5 is E.

The cathode blocks 5 and the connection bars 6 form cathode elements 20 that are usually assembled outside the pot and are added thereto during the formation of its inner lining. An electrolytic pot 10 typically comprises more than about 10 cathode elements 20 generally arranged side by side. A cathode element 20 may include one or several connection bars passing through the block from side to side, or one or several pairs of half-bars typically in line, that extend only on a part of the block.

A function of the connection bars 6 is to collect the current that passed through each cathode block 5 and to direct it to the conductor network located outside the pot. As illustrated on FIG. 1, the connection bars 6 pass through the pot 10 and are typically connected to a connecting conductor 13, usually made of aluminum, through a flexible aluminum fitting 14 connected to the segment(s) 19 of the bars that come out of the pot 10.

During operation, the pot 10 contains a pad of liquid aluminum 8 and an electrolytic bath 9 above the cathode blocks 5, and the anodes 4 dip into the bath 9. A solidified bath ridge 12 usually forms on the side linings 3'. A part 12' of this ridge 12, called the "ridge base" can project over the upper lateral surface 28 of the cathode block 5. The ridge base electrically isolates the cathode and increases the peak current density at the block head.

Figure 2:
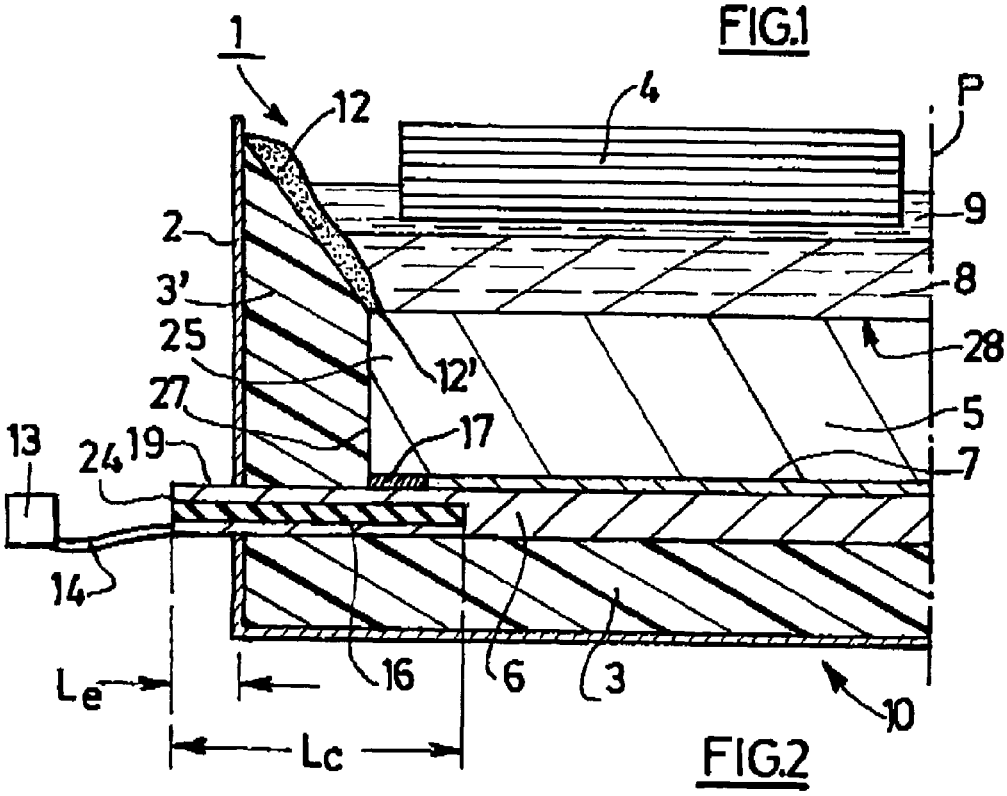
FIG. 2 is a view similar to FIG. 1 in the case of a cell comprising a cathode element according to the invention.

FIG. 2 shows an electrolytic cell 1 for the production of aluminum according to an embodiment in which the same elements are denoted using the same references as above.

As illustrated in FIG. 2, each end of the connection bar 6 is fitted with a metal insert 16, preferably made of copper or a copper alloy, extending on a length Lc, typically starting substantially from the end or each outer end of the bar 6. The insert 16 is at least partly located in the external segment or each external segment 19 of the connection bar 6 that will be located outside the pot 10.

Figure 7:
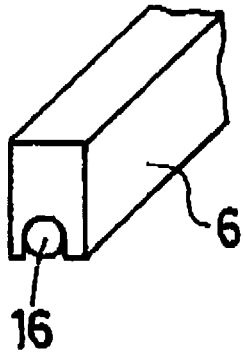
FIG. 7 shows a segment of a connection bar fitted with an insert with a circular section in a lateral groove.

The insert or each insert 16 is preferably housed in a cavity forming a blind hole inside the bar 6. This variant can avoid exposure of the insert to possible bath or liquid metal infiltrations. The cavity may comprise a groove on a side face of the bar, for example, as illustrated in FIG. 7.

The insert preferably occupies at least about 90% of the length Le of the external segment or each external segment 19 of the connection bar 6 in which it is housed to optimize the reduction in the voltage drop obtained according to the present invention.

The end surface 24 which will be outside the pot 10 is usually substantially vertical when the cathode element 20 is installed in a pot.

According to one advantageous variant of the invention, the insert or each insert 16 is substantially flush, with a determined tolerance, with the surface 24 of the end of the external segment 19 of the bar 6. The said determined tolerance is preferably less than or equal to ±1 cm.

According to another advantageous variant of the invention, the external end of each insert 16 is set back by a determined distance from the surface 24 of the end of the external segment 19 of the bar 6. The said determined distance is preferably less than or equal to 4 cm. The cavity formed by setting back the insert may advantageously contain a refractory material to prevent heat loss by radiation and/or convection.

The length Lc of the insert 16 is typically from about 10 to about 300%, preferably from about 20 to about 300%, and more preferably from about 110 to about 270%, of the length E of the "part outside the block" 22 of the bar 6 that emerges from the cathode block 5 and in which the insert is housed.

The longer the insert, the lower the cathode voltage drop. However, the applicant noted that, when the insert is longer than about 270% of the part 22 of the bar outside the block, increasing of the insert length only has a small effect on the value of the cathode voltage drop.

As illustrated in FIG. 2, preferably at least one zone 17 located between the bar 6 and the cathode block 5 does not contain any sealing material. This zone called the "unsealed" zone is advantageously completely or partly filled with an electrically insulating material such as a refractory material, typically in the form of fibers or fabric; this material is preferably inserted between the bar 6 and the cathode block 5, in the unsealed zone 17, for example, as illustrated in FIG. 5. The unsealed zone or each unsealed zone 17 is preferably located close to the end 25 of the cathode block 5 called the "block head" from which the bar emerges and covers a determined surface area S. Preferably, the unsealed zone or each unsealed zone 17 is flush with the surface 27 of the block head 25 from which the bar 6 emerges.

FIGS. 3 and 4 illustrate two particular embodiments of the cathode element 20 according to the instant invention. In the example shown in FIG. 3, the cathode element preferably includes two parallel connection bars that pass through the cathode block from side to side. Each bar then preferably includes two parts outside the block 22 and two external segments 19. In the example in FIG. 4, the cathode element preferably includes four connection bars (also called "half-bars") each of which projects at one end of the block. Each bar then comprises a single part outside the block 22 and a single external segment 19. In both examples, a conducting sealing material 7 is preferably inserted between the block 5 and each bar 6, except in areas located at the ends of the block 5 where there are unsealed zones 17 that can be filled with refractory materials.

The total area A of the determined surface(s) S of the unsealed zone(s) 17 of each connection bar 6 is typically from about 0.5 to about 25%, and preferably from about 2 to about 20%, and more preferably from about 3 to about 15%, of the area Ao of the surface So of the bar 6 that may be sealed, called the "sealable zone". The sealable surface So is the surface of the part 23 of the bar 6 that faces the internal surfaces of the groove 15 in the block 5.

When the connection bar or each connection bar 6 passes through the cathode block 5 from one side to the other as illustrated in FIG. 3, the area Ao of the sealable surface So is typically equal to Lo×(2 H+W), where H is the height of the bar and W is its width. In this case, since each connection bar 6 has an unsealed zone 17 at each end 25, the total area A is equal to the sum of the areas of each determined surface S.

When the connection bars 6 are interrupted towards the center of the block to form two half-bars in line with each other, for example, as illustrated in FIG. 4, the area Ao of the sealable surface So of each half-bar is typically equal to Li×(2 H+W), where H is the height of the bar and W is its width. In this case, since each connection half-bar 6 has an unsealed zone 17 at a single end, the total area A is equal to the area of the determined surface S of this unsealed zone. However, the applicant has observed that when the discontinuity of the bar close to the center of the block is relatively short, which is usually the case, this has little effect on the distribution of the current and the voltage drop, such that the area A can be determined as if the bars were continuous from one end to the other.

The determined surface S typically comprises a simple shape so as to facilitate formation of the unsealed zone 17. In the case illustrated in FIGS. 2 to 4, in which the unsealed zone 17 is formed by the lack of sealing over a length Ls, starting from the surface 27 of the block head 25, the area of the determined surface S is typically equal to Ls×(2H+W). In this case, the length Ls of each unsealed zone 17 is preferably from about 0.5 to about 25%, and preferably from about 2 to about 20%, and more preferably from about 3 to about 15%, of the half-length Lo/2 of the block.

The section of the insert 16 also affects the reduction of the cathode voltage drop. Advantageously, the cross section of each insert is from about 1 to about 50%, and preferably from about 5 to about 30%, of the cross section of the bar 6. For values of insert section greater than about 30% of the total section, the additional conducting quantity may in some cases significantly increase the cost without increasing performances very much.

Figure 6:
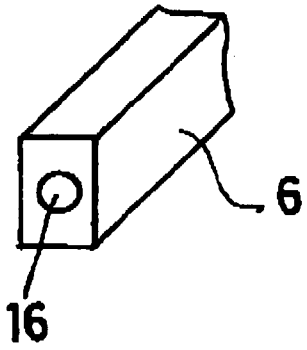
FIG. 6 shows a segment of a connection bar fitted with an insert with a circular section.

The insert 16 is typically in the form of a bar. The cross section of the insert 16 can have any desired shape. For example, its shape can possibly be rectangular (as illustrated in FIG. 5), circular (as illustrated in FIG. 6 or 7), or ovoid or polygonal or any other shape. However, it may advantageously be circular in some embodiments in order to facilitate manufacturing of the connection bar, and particularly manufacturing of the cavity in which the insert will be housed.

Digital calculations have been made to evaluate the distribution of the cathode current at the surface 28 of the cathode block obtained with configurations according to prior art and according to the present invention.

Figure 8:
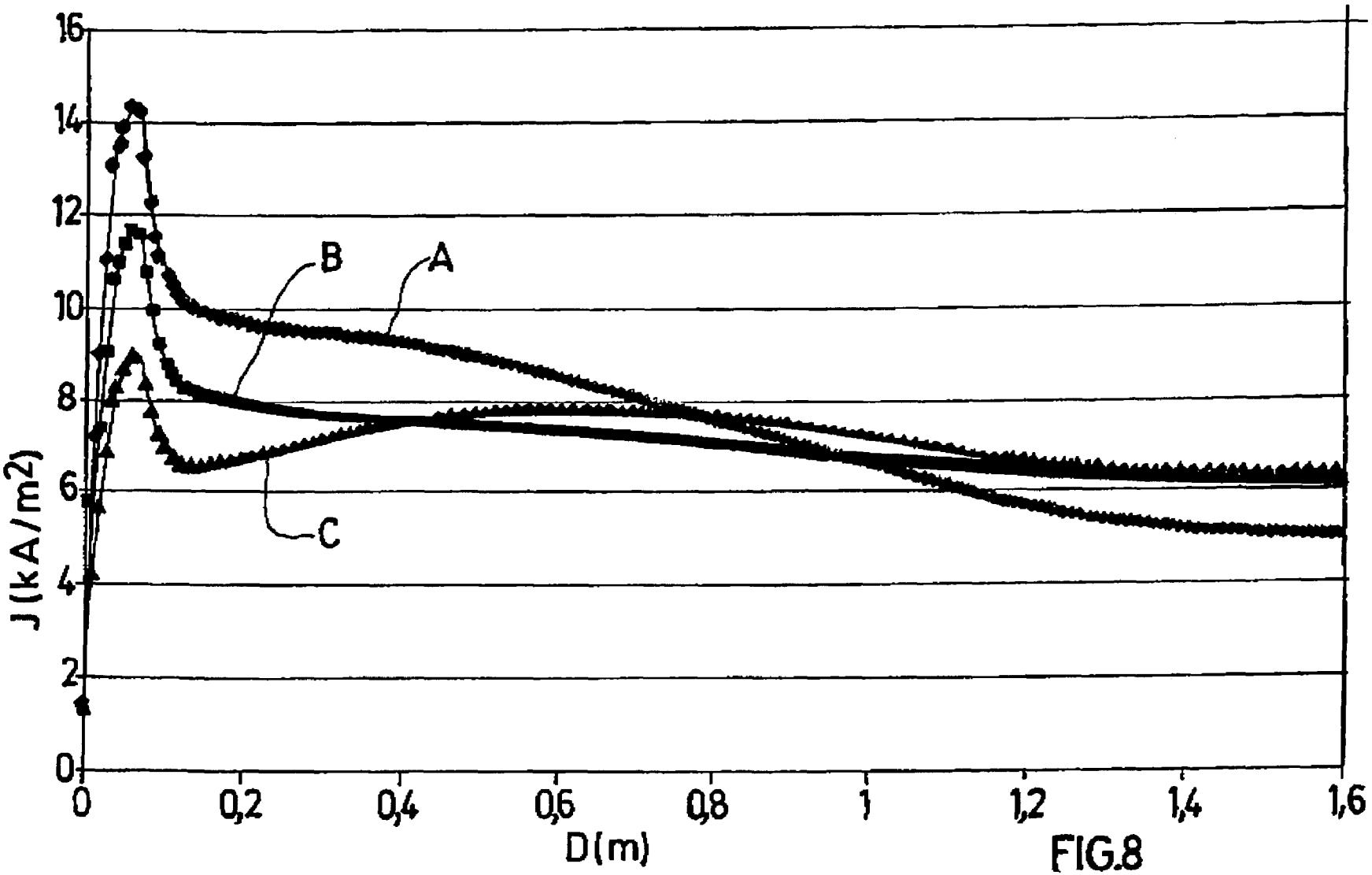
FIG. 8 shows cathode current distribution curves along a cathode block.

FIG. 8 shows the results of a calculation corresponding to the dimensions of the connection bar and a current intensity typical of existing electrolytic cells. The curves correspond to the current density J at the upper surface 28 of the block, expressed in $kA/m^2$ as a function of the distance D from the end of the block.

An exemplary cell for which the calculations were conducted comprises 20 cathode elements arranged side by side and each comprising two connection bars as illustrated in FIG. 3. The total intensity is 314 kA. The length of the connection bars L is equal to 4.3 m, the height H is equal to 160 mm and the width W is equal to 110 mm. The length E of the connection bars extending outside from the cathode blocks is 0.50 m.

Curve A, applicable to prior art, corresponds to an all-steel connection bar. The cathode voltage drop is 283 mV (between the center of the liquid metal pad and the anode frame of the downstream pot).

Curve B, applicable to prior art, applies to a steel bar with the same dimensions as in case A, but comprising a copper cylindrical insert with a length equal to 1.53 m and a diameter equal to 4.13 cm. The insert is placed along the longitudinal axis of symmetry of the bar and extends substantially from the center of the bar (in other words substantially from a central plane P of the pot) to about half the thickness of the lining of the side 3' of the cell. The cathode voltage drop is 229 mV. The reduction in the cathode drop is about 19% less than in case A, and the reduction in the peak current density is about 18%.

Curve C relating to the present invention corresponds to a steel bar with the same dimensions as in case A, but with a copper cylindrical insert with length Lc equal to 1.30 m and with a diameter equal to 4.5 cm (corresponding to a copper volume identical to that in case B). The insert is placed along the longitudinal axis of symmetry of bar and, as in FIG. 2, extends from the outer end of the bar to the inside of the cell. The length of the unsealed zone is 0.18 m and it covers the three normally sealed faces of the bar. The cathode voltage drop is 190 mV. The reduction in the cathode voltage drop is about 32% less than in case A, and the reduction in the peak current density is about 37% less than in case A. The distribution of the cathode current is significantly more uniform than in cases A and B.

Additional advantages, features and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

As used herein and in the following claims, articles such as "the", "a" and "an" can connote the singular or plural.

All documents referred to herein are specifically incorporated herein by reference in their entireties.

What is claimed is:

1. A cathode element suitable for use in a pot of an electrolytic cell intended for production of aluminum, said element comprising:

a cathode block comprising a carbonaceous material with at least one longitudinal groove along a side face thereof;

at least one steel connection bar comprising at least one external segment capable of being located outside the pot, and a first portion of said bar being housed in said groove, and a second portion of the bar having a length E emerges at least at one end of the block, and said first portion is sealed in the groove by a conducting sealing material inserted between the bar and the block, and wherein the connection bar comprises at least one metal insert with length Lc, having an electrical conductivity that is higher than the electrical conductivity of said steel in said connection bar, said metal insert being arranged longitudinally inside the bar and being located at least partly in said external segment and extending a portion of a length of the bar; and further wherein the connection bar is not sealed to the cathode block in at least one unsealed zone with a surface area S located at the end of the groove at said at least one end of the block.

2. A cathode element according to claim 1, wherein each insert comprises copper or a copper based alloy.

3. A cathode element according to claim 1, wherein the length Lc of each insert is from about 10 to about 300% of said length E.

4. A cathode element according to claim 1, wherein the length Lc of each insert is from about 20 to 300% of said length E.

5. A cathode element according to claim 1, wherein the length Lc of each insert is from about 110 to about 270% of said length E.

6. A cathode element according to claim 1, wherein the length Lc of each insert is from about 1 to about 50% of a cross section of the bar.

7. A cathode element according to claim 1, wherein a cross section of each insert is from about 5 to about 30% of a cross section of the bar.

8. A cathode element according to claim 1, wherein the total area A of the surface S of the unsealed zone of each connection bar is from about 0.5 to abut 25% of an area Ao of a surface So of the bar that is capable of being sealed.

9. A cathode element according to claim 1, wherein the total area A of the surface S of the unsealed zone of each connection bar is from about 2 to about 20% of an area Ao of a surface So of the bar that is capable of being sealed.

10. A cathode element according to claim 1, wherein the total area A of the surface S of the unsealed zone of each connection bar is from about 3 to about 15% of an area Ao of a surface So of the bar that is capable of being sealed.

11. A cathode element according to claim 1, further comprising an electrically insulating material inserted between the connection bar and the cathode block in the unsealed zone or each unsealed zone.

12. A cathode element according to claim 1, characterized in that each insert is flush, with a defined tolerance, with a surface of an end of the external segment of the bar.

13. A cathode element according to claim 12, wherein said determined tolerance is less than or equal to ±1 cm.

14. A cathode element according to claim 1, wherein an external end of each insert is set back by a determined distance from a surface of an end of the external segment of the bar.

15. A cathode element according to claim 14, wherein said determined distance is less than or equal to 4 cm.

16. A cathode element according to claim 15, wherein a cavity formed by setting back the insert comprises a refractory material.

17. A cathode element according to claim 1, wherein a cross section of each insert is circular.

18. A cathode element according to claim 1, wherein each insert is housed in a cavity forming a blind hole inside the bar.

19. A cathode element according to claim 1, wherein said carbonaceous material comprises graphite.

20. An electrolytic cell suitable for production of aluminum, comprising at least one cathode element according to claim 1.

21. A cathode element according to claim 1, wherein the insert has a first end located within the external segment and a second end located within the connection bar, inwardly of the first end.

22. A cathode element according to claim 21, wherein the second end of the insert is configured to be located inside the pot.

23. A cathode element according to claim 21, wherein the first end of the insert is flush, with a defined tolerance, with a surface of an end of the external segment of the bar.

24. A cathode element according to claim 21, wherein the first end of the insert is set back by a distance from a surface of an end of the external segment of the bar.

25. A cathode element comprising:

a cathode block comprising a carbonaceous material with at least one longitudinal groove along a side face thereof;

at least one steel connection bar comprising at least one external segment that can be located outside a pot in an electrolytic cell and housed in said groove such that a portion of the bar emerges at least at one end of the block, and said steel connection bar comprising at least one metal insert having an electrical conductivity that is higher than the electrical conductivity of said steel in said connection bar, said metal insert being arranged longitudinally inside the bar and being located at least partly in said external segment and extending a portion of a length of the bar, and wherein when said cathode element is used in said electrolytic cell, the cathode voltage drop is at least about 32% less than an all steel connection bar without said metal insert and a reduction in peak density of at least about 37% than an all steel connection bar without said insert.

26. A cathode element comprising:

a cathode block comprising a carbonaceous material with at least one longitudinal groove along a side face thereof;

at least one steel connection bar comprising at least one external segment that can be located outside a pot in an electrolytic cell and housed in said groove such that a portion of the bar emerges at least at one end of the block, and said steel connection bar comprising at least one metal insert having an electrical conductivity that is higher than the electrical conductivity of said steel in said connection bar, said metal insert being arranged longitudinally inside the bar and being located at least partly in said external segment and extending a portion of a length of the bar, and wherein when said cathode element is used in said electrolytic cell, the cathode voltage drop is more than 19% less than an all steel connection bar without said metal insert and a reduction in peak density of more than 18% compared to an all steel connection bar without said insert.

27. A cathode element comprising:

a cathode block comprising a carbonaceous material with at least one longitudinal groove along a side face thereof;

at least one steel connection bar comprising at least one external segment that can be located outside a pot in an electrolytic cell and housed in said groove such that a portion of the bar emerges at least at one end of the block, and said steel connection bar comprising at least one metal insert having an electrical conductivity that is higher than the electrical conductivity of said steel in said connection bar, said metal insert being arranged longitudinally inside the bar and being located at least partly in said external segment and extending a portion of a length of the bar, and wherein when said cathode element is used in said electrolytic cell, there is produced a drop in global cathode voltage of at least 0.1 V as compared with an entirely steel bar and a reduction in the current density at the head of the cathode block of at least about 20%.

* * * * *

UNITED STATES PATENT AND TRADEMARK OFFICE

CERTIFICATE OF CORRECTION

PATENT NO. : 7,618,519 B2
APPLICATION NO. : 11/095487
DATED : November 17, 2009
INVENTOR(S) : Delphine Bonnafous et al.

It is certified that error appears in the above-identified patent and that said Letters Patent is hereby corrected as shown below:

On the Title page,

[*] Notice: Subject to any disclaimer, the term of this patent is extended or adjusted under 35 U.S.C. 154(b) by 730 days.

Delete the phrase "by 730 days" and insert -- by 1204 days --

Signed and Sealed this

Twenty-fourth Day of August, 2010

David J. Kappos

David J. Kappos
*Director of the United States Patent and Trademark Office*